United States Patent [19]

Whelan

[11] 4,197,017

[45] Apr. 8, 1980

[54] PAINT STIRRER PADDLE

[75] Inventor: James P. Whelan, North Marshfield, Mass.

[73] Assignee: Ad-Tec Products, Inc., Plymouth, Mass.

[21] Appl. No.: 160

[22] Filed: Jan. 2, 1979

[51] Int. Cl.[2] ..... B01F 13/00

[52] U.S. Cl. ..... 366/343; 366/605; 15/236 R

[58] Field of Search ..... 366/605, 343, 129, 348, 366/349; 416/236; 15/236 R

[56] References Cited

U.S. PATENT DOCUMENTS

| | | | |
|---|---|---|---|
| 1,498,509 | 6/1924 | Arnold | 366/343 |
| 1,554,387 | 9/1925 | Thomson | 15/236 R |
| 1,732,714 | 10/1929 | Copes | 366/343 |
| 2,777,676 | 1/1957 | Carter | 366/129 |
| 3,298,671 | 1/1967 | Popma | 366/343 |
| 4,050,678 | 9/1977 | Smith | 366/343 |
| 4,141,111 | 2/1979 | Hopkins | 15/236 R |

*Primary Examiner*—Robert W. Jenkins
*Attorney, Agent, or Firm*—Robert T. Gammons

[57] ABSTRACT

A paint stirrer paddle comprising a long, narrow, corrosion-resistant metal blade having lengthwise thereof portions displaced from the plane of the blade, said portions being concavo-convex in transverse sections, of different length and of different width, and the part of the blade containing the displaced portion of lesser width and length constituting the handle of the paddle.

6 Claims, 11 Drawing Figures

PAINT STIRRER PADDLE

BACKGROUND OF INVENTION

Paint stirrer paddles in the past have always been made of wood cheaply enough so as to be expendable; however, they had some disadvantages in that they were very apt to break when attempting to stir heavy body paint now used and invariably float to the top of the paint can after stirring of the paint and must be removed and laid aside. Stirrer paddles comprised of plastics are expensive and are adversely affected by the solvent in the paint and do not provide the rigidity required. Steel paddles are expensive to manufacture and ship. Objects of this invention are to provide paint stirrer paddles which are less expensive to manufacture than wood or steel paddles, are resistant to corrosion of the paints normally encountered, are stiff enough to withstand the bending forces generated by stirring, are easy to clean, are approximately one-third the weight of steel paddles and are structured not only to enable holding and manipulating during the stirring operation, but also to augment circulation of the paint during stirring and to enable reaching into the corners at the bottom of the paint can to scrape away pigments deposited at the bottom. Other objects are to provide stirrer paddles which can be used to press putty, fillers and the like into depressions in the surfaces to be painted and to rub these surfaces smooth preparatory to painting.

SUMMARY OF INVENTION

As herein illustrated, the paint stirrer paddle comprises a long, narrow, rigid blade having spaced, parallel edges and intermediate the edges a longitudinally-extending portion displaced from the plane of the blade such as to define a protuberance on one side and a recess on the other side. The displaced portion is bounded along each side by planar portions of the blade and is upwardly convex at one side and downwardly concave on the other side. A part of the displaced portion is of smaller cross section and shorter than the remainder and defines the handle of the paddle and the remainder which is of larger cross section and longer constitutes a reinforcement for the blade of the paddle. The distal end of the blade has outwardly divergent side edges and a straight end edge and the handle has an arcuate end edge and contains near the end a hole. The handle portion is approximately one-half the length of the blade.

The invention will now be described with reference to the accompanying drawings, wherein.

Figure 1:
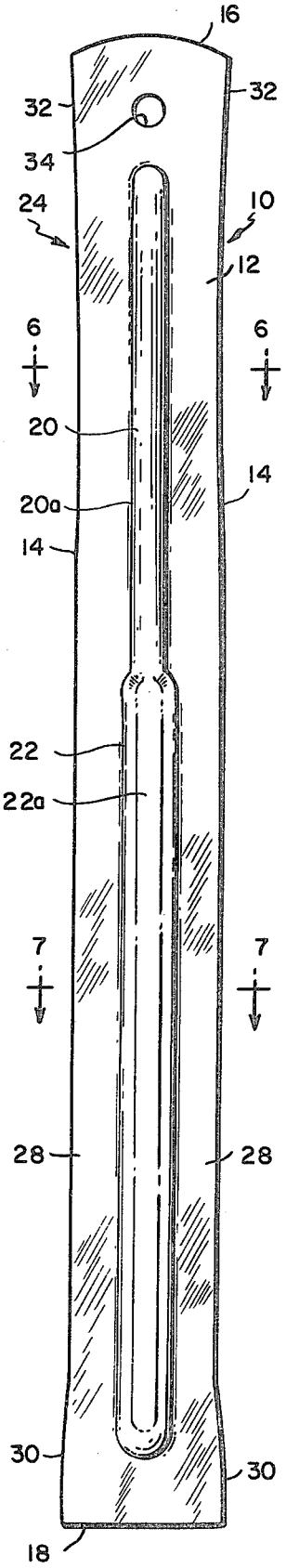
FIG. 1 is a plan view of one side of the blade.
Figure 6:
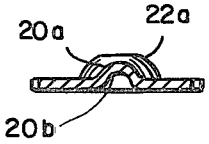
Figure 7:
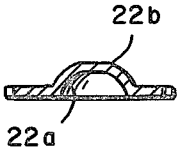
Figure 8:
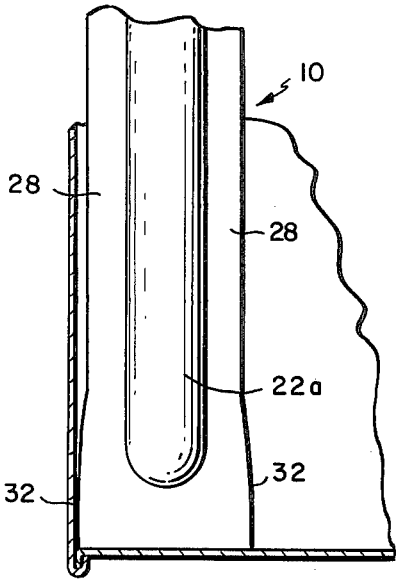
Figure 10:
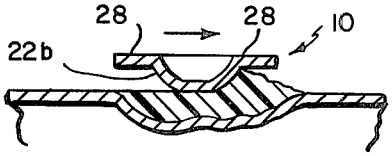
Figure 11:
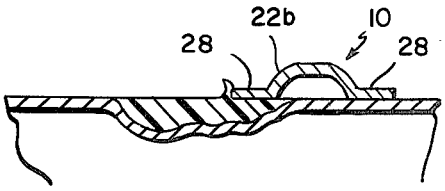
Figure 9:
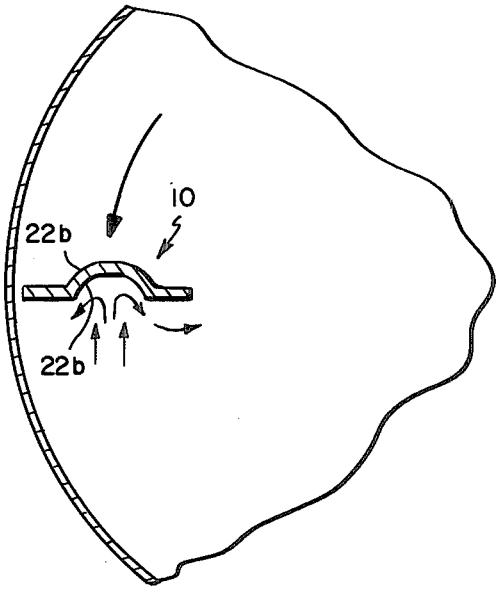

FIGS. 6 and 7 are transverse sections taken on the line 6—6 and 7—7 of FIG. 1;

FIG. 8 is a fragmentary section at the bottom of a paint can showing the function of the structured lower end of the blade;

FIG. 9 is a fragmentary horizontal section of a paint can showing the secondary circulation generated by the paddle as the latter is moved circularly in the paint can;

FIG. 10 is a fragmentary section showing how the paddle is used for pressing a filler into a dent or depression in the surface to be painted; and FIG. 11 is a fragmentary section showing how the paddle can be used to flatten and smooth out the surface of the filler after it has been pressed into place.

Figure 2:
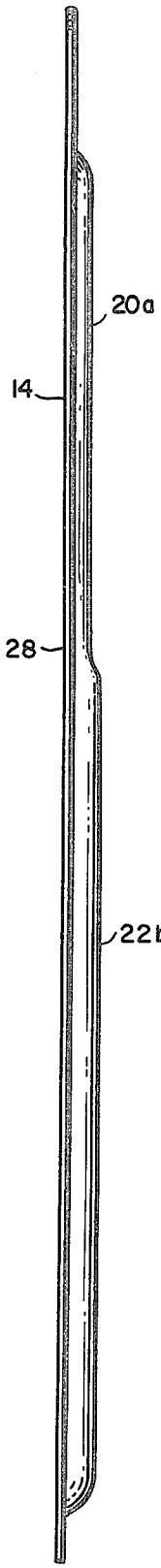
FIG. 2 is an elevation of one edge of the blade, the opposite edge being identical.
Figure 3:
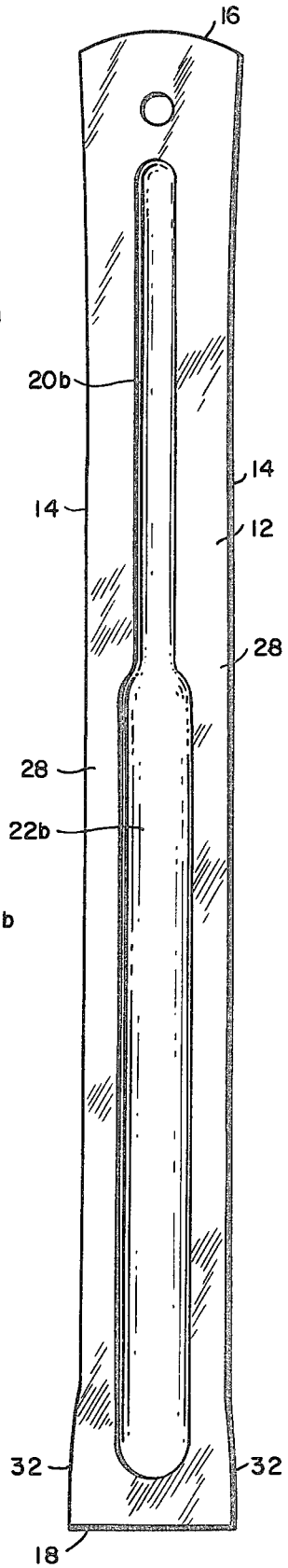
FIG. 3 is a plan view of the other side of the blade.
Figure 4:
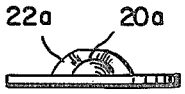
FIG. 4 is an elevation of the upper end of the blade.
Figure 5:
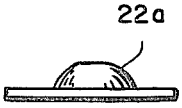
FIG. 5 is an elevation of the lower end of the blade.

Referring to FIGS. 1 to 3, the paddle 10 comprises a long, narrow, rigid blade 12 having spaced, parallel edges 14—14 and ends 16 and 18. Intermediate the edges 14—14, there are longitudinally-extending displaced portions 20 and 22 which are concavo-convex and which define lengthwise of the blade upwardly-convex surfaces 20*a* and 22*a* on one side of the blade and downwardly-concave surfaces 20*b* and 22*b* on the other side. The cross-sectional configuration of the displaced portions 20 and 22 are shown in FIGS. 6 and 7. The displaced portion 20 is of lesser length than the displaced portion 22 approximately half the length thereof, is confined to the handle portion 24 of the paddle and provides means for receiving the fingers of the person using the paddle so as to enable firmly gripping the paddle. The displaced portion 22 of larger section is contained within the blade portion of the paddle which is submerged in the paint when stirring the paint and constitutes means for rigidifying the blade sufficiently to withstand any bending stresses imparted thereto by stirring. The displaced portions are bounded along their opposite sides by planar portions 28—28 which are uniformly flat. At the distal end of the blade edges diverge at 30—30. The end edge 18 is straight and the handle also has slightly divergent edges 32—32, an arcuate end edge 16 and contains a hole 34.

The structural configuration of the blade affords advantages in use beyond the mere stirring provided for by a flat wood paddle or steel paddle. As already stated, the displaced portion 20 in the handle enables obtaining a better grip on the paddle for stirring and, at the same time, stiffens the handle. The displaced portion 22 of the blade not only stiffens the blade, but functions as shown in FIG. 9 to create a secondary circulation as indicated by the arrows within the body of paint being moved ahead of the paddle by the circular movement of the paddle within the paint can. Additionally, the divergent edges 30—30 at the lower end of the blade make it possible to scrape pigment deposited at the bottom of the paint can from the bottom and corner at the bottom as shown in FIG. 8.

The paddle as described has a secondary function apart from stirring paint in that the convex side of the displaced portion 22*b* at the one side of the paddle can be used as shown in FIG. 10 to press putty or a filler into the surface depression of the surface to be painted and then the planar portions 28—28 at the other side can be used to spread the putty or filler smoothly prior to painting. The paddle is comprised of a corrosion-resistant metal, for example, an aluminum alloy and can be readily stamped or die-cut with little or no burring from sheet metal in quantity at a very low cost per unit paddle. The nonabsorbent surface of the metal can be readily cleaned by wiping with a paint solvent so that the paddle can be used over and over and its weight is about one-third that of a steel paddle of corresponding size.

It should be understood that the present disclosure is for the purpose of illustration only and includes all modifications or improvements which fall within the scope of the appended claims.

What is claimed is:

1. A paint stirrer comprising a relatively long, narrow paddle, a portion of which is structured to provide a handle and the remainder of which is structured to provide a stirring blade, said paddle having a longitudinally-extending intermediate portion which is transversely concavo-convex defining on one side a longitudinally-extending concave groove and on the other side a longitudinally-extending rib, and longitudinally-extending, transversely-flat planar portions bounding the longitudinal sides of the intermediate portion, said longitudinally-extending intermediate portion constituting stiffening means imparting rigidity to the paddle and embodying portions of different transverse cross section in the handle portion and the blade portion, the portion of concavo-convex section in the blade portion constituting in addition to a stiffener deflector means which contributes to circulation of the paint when stirring, the convex portion of the concavo-convex section of the blade providing means for pressing a filler into depressions in the surface to be painted and the flat planar portions at opposite sides of the concavo-convex section providing means for spreading the filler smoothly prior to painting.

2. A paint stirrer paddle according to claim 1 wherein the handle has an arcuate end edge and contains near the end a hole.

3. A paint stirrer paddle according to claim 1 wherein the handle portion is approximately one-half the length of the blade portion.

4. A paint stirrer paddle according to claim 1 wherein the blade is comprised of a corrosion-resistant material.

5. A paint stirrer paddle according to claim 1 wherein the blade is comprised of an aluminum alloy.

6. A paint stirrer according to claim 1 wherein the longitudinal edges at the distal end of the blade diverge in the plane of the planar portions and the end edge is straight.

* * * * *